United States Patent [19]

Geberth, Jr.

[11] Patent Number: 4,494,697

[45] Date of Patent: Jan. 22, 1985

[54] SPRAY CONTROL VALVE

[76] Inventor: John D. Geberth, Jr., 10 Goose Cove La., Ramsey, N.J. 07446

[21] Appl. No.: 457,195

[22] Filed: Jan. 11, 1983

[51] Int. Cl.[3] ..... B05B 1/32

[52] U.S. Cl. ..... 239/124; 239/455; 137/312

[58] Field of Search ..... 239/455, 124, 530; 137/312

[56] References Cited

U.S. PATENT DOCUMENTS

| | | | |
|---|---|---|---|
| 3,354,897 | 11/1967 | Koch et al. | 137/312 |
| 4,269,355 | 5/1981 | Geberth | 239/455 X |
| 4,346,841 | 8/1982 | Fenne | 137/312 X |
| 4,389,017 | 6/1983 | Geberth | 239/455 |

*Primary Examiner*—John J. Love
*Assistant Examiner*—Daniel R. Edelbrock
*Attorney, Agent, or Firm*—Collard, Roe & Galgano

[57] ABSTRACT

An improved control valve is provided which is utilized in spray guns and like devices for hydraulically atomizing and spraying liquids such as paint wherein the spray control valve functions as the spray tip, the spray control valve being mounted in a housing attached to the spray gun handle and includes a fluid bore communicating with the pressurized liquid supplied to the spray gun, a valve bore intersecting the fluid bore and substantially transverse thereto, and a spray opening substantially aligned with said fluid bore and intersected by said valve bore, the spray gun further includes a valve pin moveable in said valve bore and normally biased to obstruct the spray opening, and a trigger means for moving the valve pin against the biasing action to unobstruct the spray opening and define the extent thereof. The improvement in the spray control valve comprises exposing a circumferential segment of the valve bore to the atmosphere by means of a relief bore formed in the spray control valve intersecting the valve bore, the relief bore having a diameter greater than the valve bore so that a circumferential segment of the valve bore is thereby exposed to the atmosphere to thereby relieve the pressure of any liquid material which infiltrates into the valve bore between the wall thereof and the valve pin.

4 Claims, 6 Drawing Figures

SPRAY CONTROL VALVE

The present invention relates generally to the control valve utilized in spray guns and like devices for hydraulically atomizing and spraying liquids such as paint wherein the control valve functions as the spray tip or nozzle and, more particularly, it relates to an improvement in such a control valve which enhances the on-off control of the spray gun.

In my earlier filed application, now U.S. Pat. No. 4,389,017, granted June 21,1983, I have described a novel and improved spray gun wherein the spray tip or nozzle also serves as the on-off control valve for the hydraulically operated spray gun. The complete details and operation of this spray gun are shown and described in the specification and drawings of that application and that disclosure is incorporated herein by reference. Briefly, such a spray gun includes a handle portion and a spray head portion. The spray head portion consists of a spray tip assembly and a trigger assembly mounted in a housing attached to the handle portion. The spray tip assembly includes a spray valve fixedly mounted in a spray tip housing, a valve pin assembly which cooperates with the spray valve and a valve pin actuator which is acted upon by the trigger assembly. The spray tip assembly is clearly shown in FIG. 4 of the referenced application. The spray valve includes a fluid bore which communicates with the high pressure fluid supplied to the spray gun, a valve bore which intersects and is substantially transverse to the fluid bore and a spray opening substantially aligned with the fluid bore and which is also intersected by the valve bore. The valve pin assembly includes a valve pin which is moveable in the valve bore of the spray valve, the positioning of which defining the extend of the spray opening, a biasing means for normally biasing the valve pin to close the spray opening and an adjustment means for varying a limit stop for the valve pin to thereby define the maximum extend of the spray opening. Activation of the trigger causes the valve pin actuator to retract the valve pin against the action of the biasing means, the extent of trigger depression determining the extent of valve pin retraction and thus the extend of the spray opening up to the limit stop. In operation, as the spray gun trigger is activated thus retracting the valve pin and opening the spray opening, the high pressure fluid is permitted to escape through the spray opening as a fan spray suitable for painting, etc.

Obviously, in order for any hydraulically operated spray gun to function, it is necessary that adequate seals are maintained between the various parts so that the high pressure liquid or paint does not leak therebetween. Thus, in the spray gun of the referenced application, since the valve pin is a moving part it is necessary that the tolerance between the valve pin and the valve bore of the spray valve be extremely close. However, it has been found that in the case of some materials being sprayed, the material infiltrates between the valve pin and the valve bore and because of the hydraulic pressure travels up the valve bore to some extent. The effect of this is to sometimes hinder the movement of the valve pin in the valve bore. In the worst case this hindrance can prevent the closing of the spray opening when the spray gun trigger is released if the biasing means is insufficient to overcome the force exerted on the valve pin by the infiltrated material. One means of overcoming this problem would be to increase the biasing force of the valve pin biasing means. This solution is not entirely satisfactory since the spray gun operator must overcome the force of the biasing means when activating the trigger and after long operation this can be somewhat fatiguing.

It is, therefore, a primary object of the present invention to improve the control of the spray gun described above by controlling the infiltration of the material to be sprayed into the moving parts of the control valve.

This object, as well as others which will hereinafter become apparent, is accomplished in accordance with the present invention by the provision, in the spray gun shown and described in the above referenced application, of an improved spray control valve where the hydraulic pressure forcing the liquid material along the valve bore of the spray control valve between the wall of the bore and the valve pin is relieved. This pressure relief is accomplished by exposing a circumferential segment of the valve bore of the spray control valve proximate to the spray opening to the atmosphere so that as the fluid material to be sprayed in pushed along the wall of the valve bore by the hydraulic pressure it exits into the relief opening and thus into the atmosphere.

The present invention will be described and understood more readily when considered together with the accompanying drawings, in which.

Figure 1:
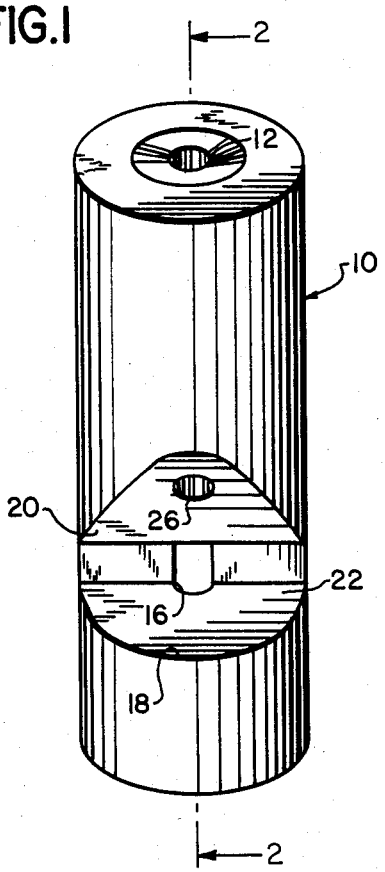
FIG. 1 is an enlarged front perspective view of the spray control valve according to the present ivention.
Figure 2:
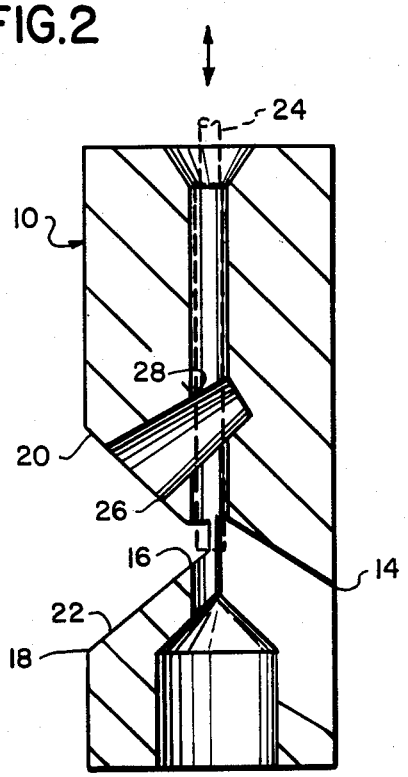
FIG. 2 is a cross-sectional view of the spray control valve of FIG. 1 taken along the line 2—2 of FIG. 1.

Referring now to the drawings, there is shown in FIGS. 1 and 2 a spray control valve, generally designated 10, which may have any suitable shape desired but for ease of manufacture is cylindrically shaped as shown. An axial valve bore, generally designated 12, is provided in spray control valve 10 and preferably is centrally located therein when control valve 10 is cylindrically shaped. A fluid bore, generally designated 14, is provided in spray control valve 10 substantially transverse to and intersecting valve bore 12, as clearly seen in FIG. 2. Fluid bore 14 is positioned in spray control valve 10 so that it is axially aligned with the source of high pressure fluid in the spray gun, as clearly seen in FIG. 2 of the referenced U.S. Pat. No. 4,389,017.

A spray opening, generally designated 16, is formed in spray control valve 10 provided by the provision of a generally "V" shaped groove, designated 18, which partially intersection valve bore 12 thus forming the opening 16. Groove 18 forms substantially planar intersecting surfaces 20 and 22 in spray control valve 10. Spray opening 16 is positioned in spray control valve 10 opposite from fluid bore 14 which preferably is sized to encompass all of spray opening 16.

As clearly seen in FIG. 2, the on-off control as well as adjustability for spray control valve 10 is provided by a valve pin, shown in phantom and designated 24, in valve bore 12. Valve pin 24 is controllably moveable in valve bore 12, as seen by the direction arrows, such that in its fully extended position with the spray gun trigger inactivated spray opening 16 is obstructed thereby. As the spray gun trigger is depressed or activated, valve pin 24 is moved to unobstruct spray opening 16 and its positioning thereby defines the extent of the spray opening. This operation of the control valve is fully described in the referenced application.

As described above, it is sometimes possible for some of the fluid material being sprayed to move up valve bore 12 between the wall thereof and valve pin 24 and possibly hinder the operation of the valve pin. In order to prevent this, a pressure relief is provided in valve bore 12 by means of a relief bore, generally designated 26, which intersects valve bore 12. The diameter of relief bore 26 is greater than that of valve bore 12 thus exposing a circumferential segment, designated 28, of the valve bore to the atmosphere. Thus, the fluid material which finds its way into valve bore 12 exits therefrom through relief bore 26 and enters the atmosphere. Preferably, circumferential segment 28 is proximate to spray opening 16 so that at any particular time a limited amount of fluid material is in valve bore 12 to interfere with the movement of valve pin 24. Also, it is preferably that relief bore 26 be proximate to spray opening 16 so that the fluid material exiting therefrom is atomized and carried away by the spray issuing from the spray opening. Thus, relief bore 26 is positioned in planar surface 20 of groove 18, as clearly seen in FIGS. 1 and 2.

Figure 4:
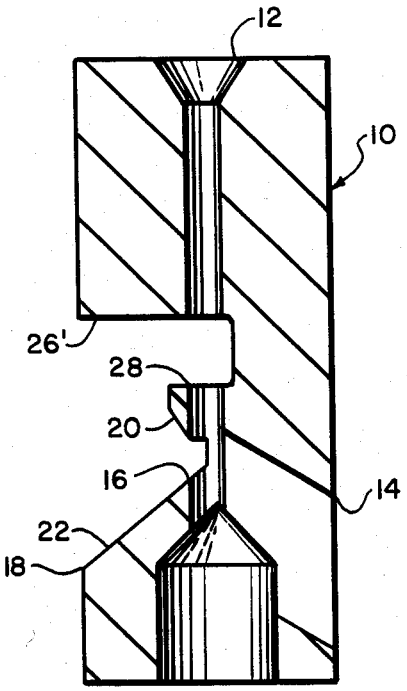
FIG. 4 is a cross-sectional view of the spray control valve of FIG. 3 taken along line 4—4 of FIG. 3.
Figure 3:
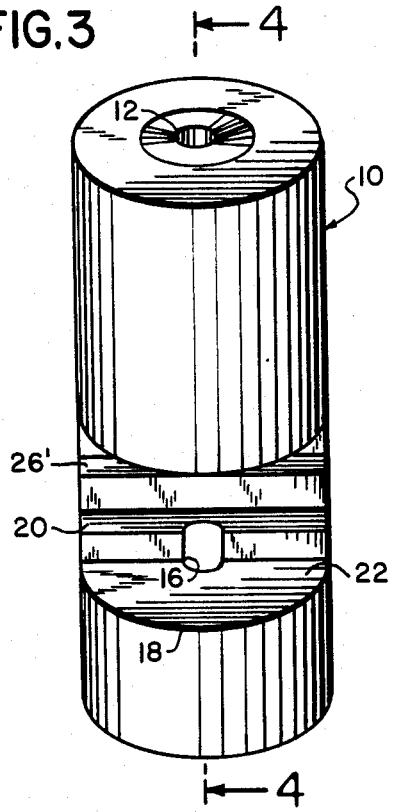
FIG. 3 is an enlarged front perspective view of another embodiment of the spray control valve according to the present invention.

Another embodiment of the invention described above is shown in FIGS. 3 and 4 wherein like numerals define like parts of the two embodiments. As clearly seen in FIG. 4, the pressure relief shown therein rather than being a bore as in FIGS. 1 and 2 is formed by a groove, designated 26', positioned proximate to and substantially parallel to spray opening 16. Relief groove 26' is formed deep enough into spray control valve 10 so as to encompass valve bore 12 to thus expose the circumferential segment 28. The function of relief groove 26' is the same in all respects to the relief bore 26 described in connection with the embodiment of FIGS. 1 and 2.

Figure 5:
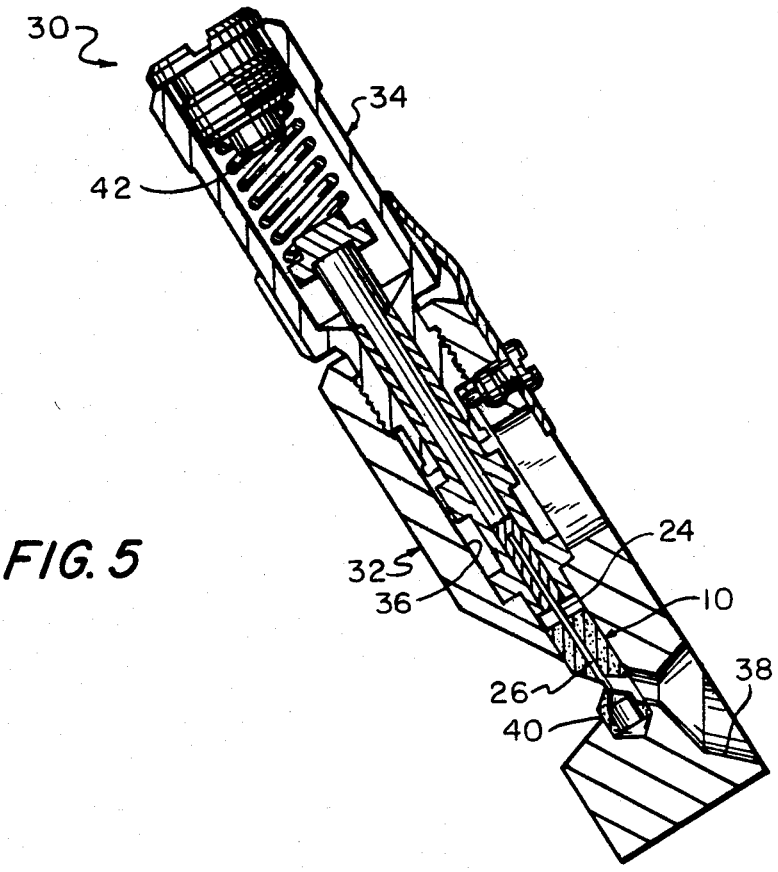
FIG. 5 is a spray tip assembly shown partly in cross section within which the spray control valve of the present invention is utilized.

In FIG. 5 there is shown a spray tip assembly, designated 30, which includes a housing, generally designated 32, and valve pin assembly, generally designated 34. Housing 32 is provided with a bore, designated 36, which threadably receives valve pin assembly 34 therein. Bore 36 extends partially through housing 32 to intersect fluid bore 38 therein. Opening 40 is formed in housing 32 by the intersection with bore 36 substantially opposite fluid bore 38. Spray valve 10 is press fitted into bore 36 of housing 32 so that valve bore 12 is coaxially aligned with bore 36 and spray opening 16 of the spray valve is aligned with opening 40 in housing 32. Fluid bore 14 of spray control valve 10 is thereby aligned with bore 38 of housing 32. Valve in 24 of valve pin assembly 34 extends into valve bore 12 and is biased by means of spring 42 to normally obstruct spray opening 16.

Figure 6:
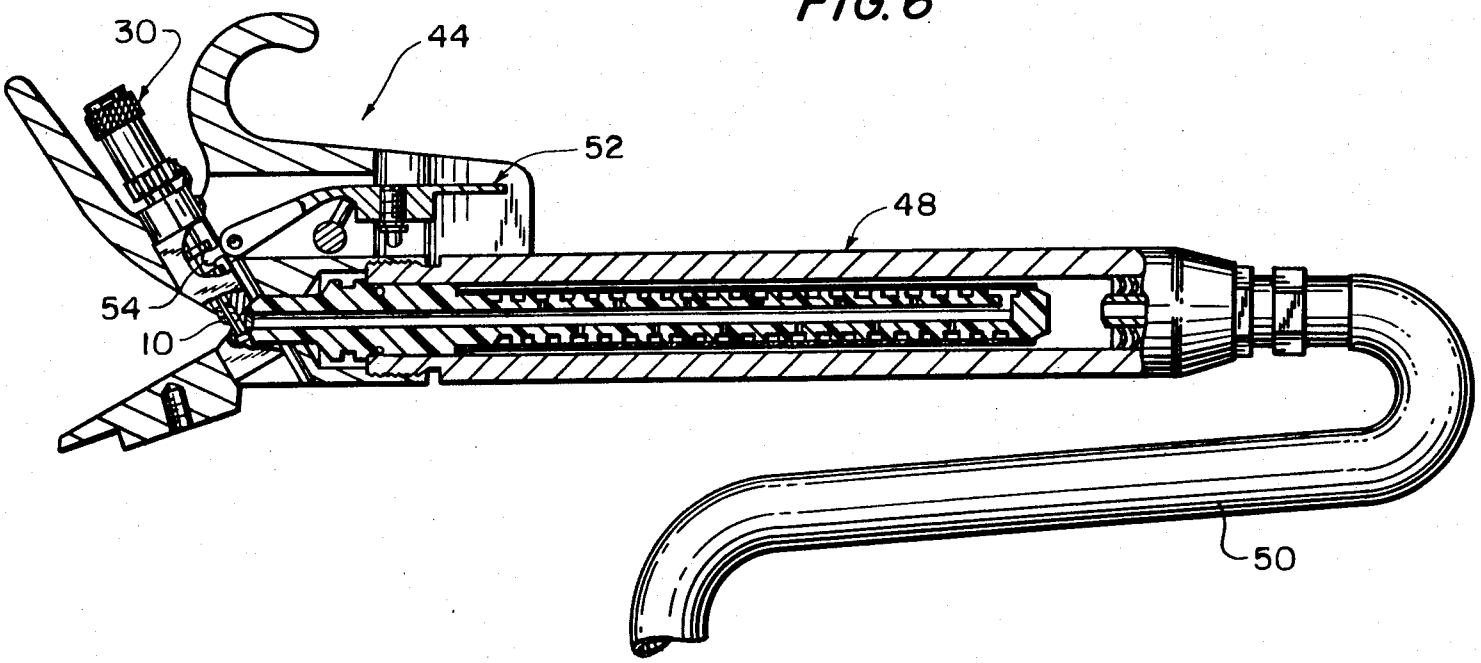
FIG. 6 is a spray gun shown partly in cross section housing the spray tip assembly of FIG. 5.

Spray tip assembly 30 is mounted in a spray gun, generally designated 44, as clearly seen in FIG. 6, so that fluid bore 14 of spray control valve 10 is aligned with bore 46 in the handle portion 48 of the spray gun which in turn communicates with the pressurized fluid via conduit 50. A trigger, designated 52, is mounted to spray gun 44 so that its actuator, designator 54, engages with the mechanism of valve pin assembly 34 so as to permit the retraction of valve pin 24 in spray control valve 10 against the biasing action of spring 42.

the essence of the present invention lies in exposing circumferential segment 28 of valve bore 12 proximate to spray opening 16 to the atmosphere. Hence, although only two embodiments have beed described above, any suitable means which accomplishes this result is satisfactory. Thus, it is to be understood that the foregoing general and detailed descriptions are only explanatory of the present invention and are not to be interpreted as restrictive of the scope of the following claims.

What is claimed is:

1. In a spray control valve of the type used with a spray gun adapted for hydraulically atomizing and spraying liquids wherein the spray control valve functions as the spray tip, the spray control valve is mounted in a housing attached to the spray gun handle and includes a fluid bore communicating with the pressurized liquid supplied to the spray gun, a valve bore intersecting said fluid bore and substantially transverse thereto, and a spray opening substantially aligned with said fluid bore and intersected by said valve bore, the spray gun further includes a valve pin moveable in said valve bore and normally biased to obstruct said spray opening, and trigger means for moving said valve pin against said biasing action to unobstruct said spray opening and define the extent thereof, the improvement in said spray control valve comprising a relief bore formed in said spray control valve intersecting said valve bore proximate to said spray opening, said relief bore having a diameter greater than said valve bore so that a circumferential segment of said valve bore is exposed to the atmosphere to thereby relieve the pressure of any liquid material which infiltrates into said valve bore between the wall thereof and said valve pin.

2. The spray control valve as defined in claim 1 wherein said relief bore is positioned proximate to said spray opening so that the liquid material which escapes to the atmosphere therethrough is picked up by the spray issuing from the spray opening and atomized thereby.

3. In a spray control valve of the type used with a spray gun adapted for hydraulically atomizing and spraying liquids wherein the spray control valve functions as the spray tip, the spray control valve is mounted in a housing attached to the spray gun handle and includes a fluid bore communicating with the pressurized liquid supplied to the spray gun, a valve bore intersecting said fluid bore ann substantially transverse thereto, and a spray opening substantially aligned with said fluid bore and intersected by said valve bore, the spray gun further includes a valve pin moveable in said valve bore and normally biased to obstruct said spray opening, and trigger means for moving said valve pin against said biasing action to unobstruct said spray opening and define the extent thereof, the improvement in said spray control valve comprising a groove in said spray control valve intersecting said valve bore proximate to said spray opening deep enough to encompass the valve bore and expose a circumferential segment thereof to the atmosphere to relieve the pressure of any liquid material which infiltrates into said valve bore between the wall thereof and said valve pin.

4. The spray control valve as defined in claim 3 wherein said groove is positioned proximate to and substantially parallel with said spray opening so that the liquid material which escapes to the atmosphere therethrough is picked up by the spray issuing from the spray opening and atomized thereby.

* * * * *